US006347991B1

(12) United States Patent
Bogrett et al.

(10) Patent No.: US 6,347,991 B1
(45) Date of Patent: Feb. 19, 2002

(54) HINGED VENT CHUTE

(75) Inventors: Blake Boyd Bogrett; Dennis Robert Larratt; John Brooks Smith, all of Littleton, CO (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/690,421

(22) Filed: Oct. 17, 2000

(51) Int. Cl.[7] ..... F24F 7/02

(52) U.S. Cl. ..... 454/260; 454/250; 55/95; 55/199

(58) Field of Search ..... 454/260, 250; 52/95, 199

(56) References Cited

U.S. PATENT DOCUMENTS 4,096,790 A * 6/1978 Curran ..... 454/260
4,184,416 A * 1/1980 Koontz ..... 454/260
4,189,878 A * 2/1980 Fitzgerald ..... 454/260
4,214,510 A * 7/1980 Ward ..... 454/260

* cited by examiner

*Primary Examiner*—Jiping Lu
(74) *Attorney, Agent, or Firm*—John D. Lister

(57) ABSTRACT

A hinged vent chute, for providing ventilation to an open attic space, includes an elongated chute segment and an insulation dam segment. The elongated chute segment has one or more upwardly open channels, extending from a lower end to an upper end of the chute segment, that provide an air passage from a soffit region of a roof, over an interior surface of the roof, up into an open attic space beneath the roof. The hinged vent chute has a hinge or fold line joining the elongated chute segment to the insulation dam segment which permits the vent chute to be folded downward at the hinge to position the insulation dam segment for securement to form an insulation dam which prevents loose fill insulation in an attic from flowing down into a soffit region of a roof and blocking air flow. The insulation dam segment may also have one or more hinge or fold lines intermediate the ends of the insulation dam segment to permit the insulation dam segment to be folded intermediate its ends when positioning the insulation dam segment for securement to form the insulation dam.

8 Claims, 2 Drawing Sheets

HINGED VENT CHUTE

BACKGROUND OF THE INVENTION

The present invention relates to vent chutes for providing ventilation to an open attic space and, in particular, to hinged vent chutes which also function as insulation dams to prevent loose fill insulation in an attic from flowing down into a soffit region of a roof and blocking air flow.

Proper ventilation of an open attic space is needed to help: keep a house cool in the summer; prevent condensation during the winter when house interiors are heated; and prevent the formation of ice dams in the winter which can cause water to backup under shingles and leak into a house. Vapor barriers help, but they are not infallible, so something must be done to provide an airflow, through an unheated open attic space. Gable roofs 20, such as the gable roof of FIG. 6, can be ventilated by installing gable and/or ridge vents (not shown); soffit vents 22; and vent chutes 100 intermediate successive rafters 24 of the roof for providing air passages from the soffit region of the roof, over an interior surface of the roof, up into the open attic space. From the open attic space the air passes out through the gable and/or ridge vents. Normally, the rooms beneath the open attic space are insulated from the open attic space by glass fiber insulation batts or blankets 26 positioned intermediate successive ceiling joists 28 and/or loose fill insulations 30, such as, but not limited to, glass fiber blowing wool. Each ceiling joist 28 is normally secured at its ends to rafters 24, but a portion of the ceiling joist 28 in FIG. 6 has been broken away to better illustrate the placement, when used, of glass fiber insulation batts or blankets 26 intermediate the ceiling joists. When loose fill insulations 30 are used to insulate the rooms below from the open attic space, separate insulation retainers or dams 102 are currently installed beneath the vent chutes 100, as shown in FIG. 6, to prevent the loose fill insulation 30 in the attic from flowing down into the soffit region of the roof and blocking the airflow through the soffit from the soffit vents 22 to the vent chutes 100. The need to separately install vent chutes 100 and loose fill insulation retainers or dams 102 increases labor costs when insulating an attic and thus, there has been a need to reduce these costs.

SUMMARY OF THE INVENTION

The hinged vent chute of the present invention both vents an open attic space to a soffit region of a roof and functions as a retainer or dam for preventing loose fill insulation from flowing from an attic down into a soffit region to block the airflow from the soffit vents through the soffit to the hinged vent chute. With its one piece construction, the hinged vent chute of the present invention simplifies installation of the vent chute and insulation dam and reduces installation costs. The hinged vent chute includes an elongated chute segment and an insulation dam segment. The vent or air passage from the soffit to the open attic space is provided by one or more upwardly open channels extending from a lower end to an upper end of the elongated chute segment. The air passes through the channel(s) and over an interior surface of the roof from the soffit region of the roof up into the open attic space beneath the roof. The hinged vent chute has a hinge or fold line which joins the insulation dam segment to the elongated chute segment. The hinge or fold line permits the insulation dam segment to be folded or bent downward at the hinge or fold line relative to the elongated chute segment and secured in place to form an insulation dam which prevents loose fill insulation in an attic from flowing down into a soffit region of a roof and blocking airflow. The insulation dam segment may also have one or more hinge or fold lines intermediate the ends of the insulation dam segment to permit the insulation dam segment to be folded intermediate its ends when positioning the insulation dam segment for securement to form the insulation dam.

DESCRIPTION OF THE PREFERRED EMBODIMENTS

Figure 1:
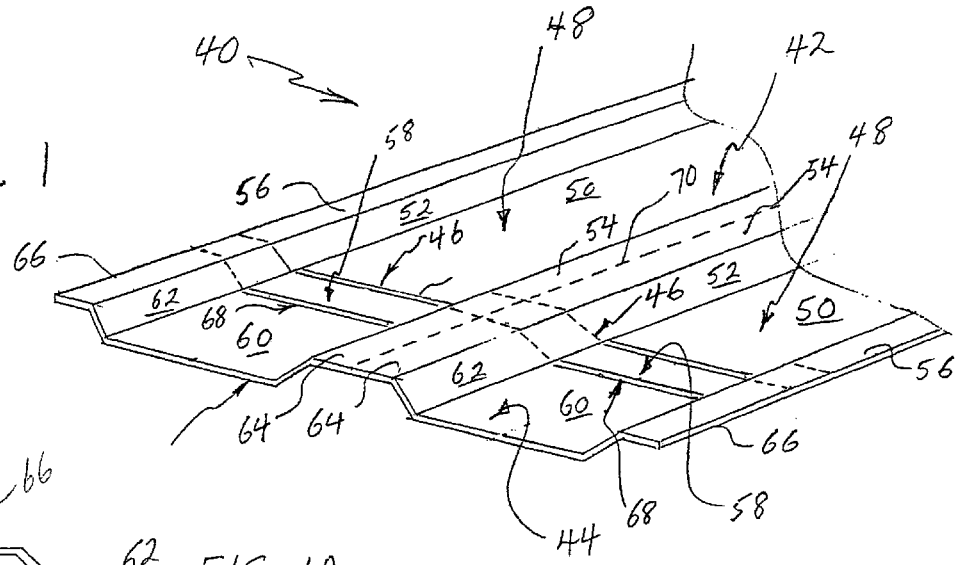
FIG. 1 is a perspective schematic view of a first embodiment of the hinged vent chute of the present invention with a portion of the elongated chute segment of the hinged vent chute broken away.

FIG. 1 shows a one piece, elongated, hinged vent chute 40 of the present invention for providing ventilation to an open attic space. The hinged vent chute 40 includes an elongated chute segment 42 and an insulation dam segment 44 which are joined by a transverse hinge or fold line 46.

As shown in FIG. 1, the elongated chute segment 42 of the hinged vent chute 40 has two elongated, upwardly open channels 48 which extend from the hinge or fold line 46 at a lower end of the elongated chute segment 42 to an upper free end of the elongated chute segment 42. When the hinged vent chute 40 is installed, the upwardly open channels 48 provide an air passage from the soffit region of a roof, over an interior surface of the roof, up into an open attic space beneath the roof. Each channel 48 of the elongated chute segment 42 has a generally U-shaped transverse cross section with a midportion 50; a pair of sidewalls 52 extending upward from lateral edge portions of the midportion 50; and a pair of inwardly and outwardly directed flanges 54 and 56, adapted to be placed against and stapled or otherwise secured to the interior surface of a roof, extending in a generally common plane from upper edge portions of the sidewalls 52.

Preferably, the insulation dam segment 44 has the same transverse cross section as the elongated chute segment 42 with two upwardly open channels 58 which extend from the hinge or fold line 46 at an upper end of the insulation dam segment 44 to a lower free end of the insulation dam segment 44. Each channel 58 of the insulation dam segment 44 has a generally U-shaped transverse cross section with a midportion 60; a pair of sidewalls 62 extending upward from lateral edge portions of the midportion 60; and a pair of inwardly and outwardly directed flanges 64 and 66 extending in a generally common plane from upper edge portions of the sidewalls 62.

As mentioned above, the lower end of the elongated chute segment 42 is joined to the upper end of the insulation dam segment 44 by a hinge or fold line 46, extending generally perpendicular to the lengths of the elongated chute segment and the insulation dam segment between the lateral edges of the elongated chute segment and the insulation dam segment. The hinge or fold line 46 permits the insulation dam segment 44 to be folded downward relative to the elongated chute segment 42 along the hinge or fold line 46 with the sidewalls 62 and inner and outer flanges 64 and 66 of the channels 58 of the insulation dam segment 44 separating from the sidewalls 52 and inner and outer flanges 54 and 56 of the channels 48 of the elongated chute segment 42 to enable the folding or bending of the hinged vent chute 40 along the hinge or fold line 46. The portions of the hinge or fold line 46 located at the junctures of the midportions 50 and 60 of the channels 48 and 58 maintain the insulation dam segment 44 integral with the elongated chute segment 42 when the insulation dam segment 44 is folded downward along the hinge or fold line 46 relative to the elongated chute segment 42. Preferably, the portions of the hinge or fold line 46 which fold and maintain the insulation dam segment 44 integral with the elongated chute segment 42 are score lines which are molded or otherwise formed in the hinged vent chute 40 at the juncture between the midportions 50 and 60 of the channels 48 and 58 and the separable portions of the hinge or fold line 46 are perforated lines, slits or other lines of weakness formed in the hinged vent chute 40 at the juncture between the sidewalls 52 and flanges 54 and 56 of the channels 48 and the sidewalls 62 and flanges 64 and 66 of the channels 58 which enable the hinge or fold line 46 to be separated or broken apart along these separable portions.

Figure 1A:
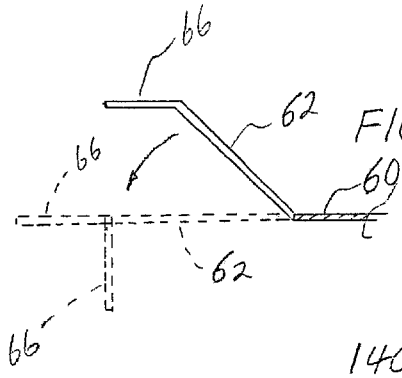
FIG. 1A is a partial cross section view of the insulation dam segment of the hinged vent chute of FIG. 1, taken substantially along the hinge or fold line joining the elongated chute segment and the insulation dam segment, to show in phantom line how the lateral edge portions of the insulation dam segment may be extended and positioned to provide stapling or securement flanges after the insulation dam segment is folded downward relative to the elongated vent chute segment.
Figure 3:
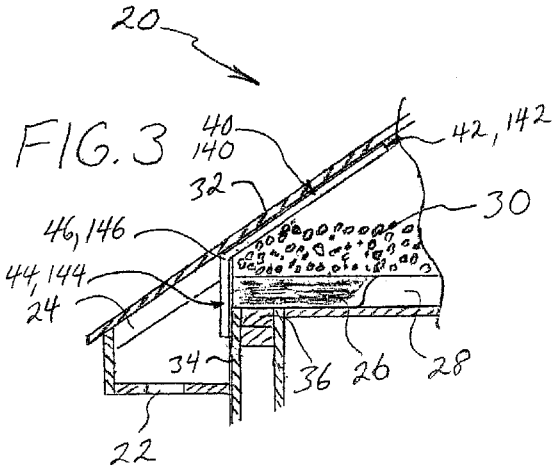
FIGS. 3 to 5 are schematic transverse vertical cross sections through lower portions of gable roofs showing three different methods of securing a hinged vent chute of the present invention in place to provide both an air passage to an open attic space and a loose fill insulation retainer or dam.
Figure 4:
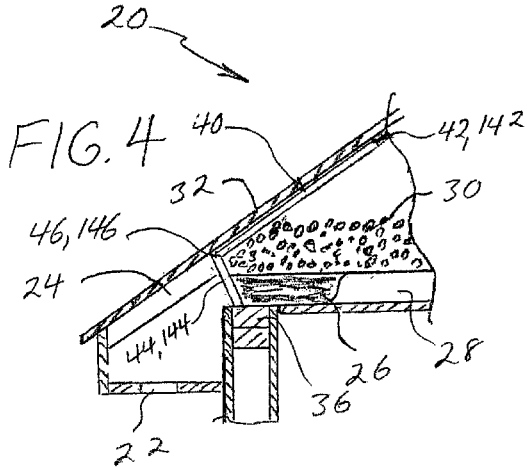
Figure 5:
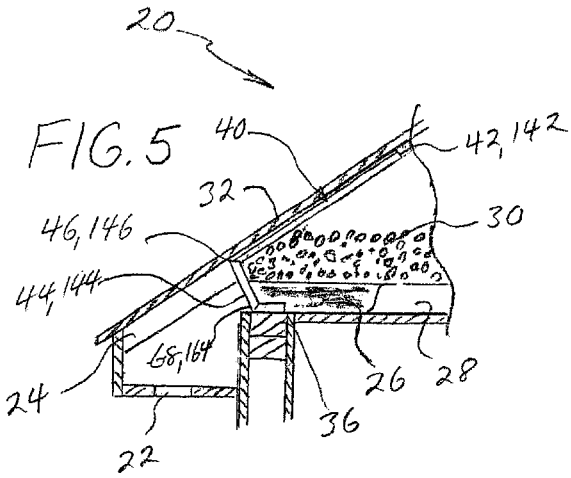
Figure 6:
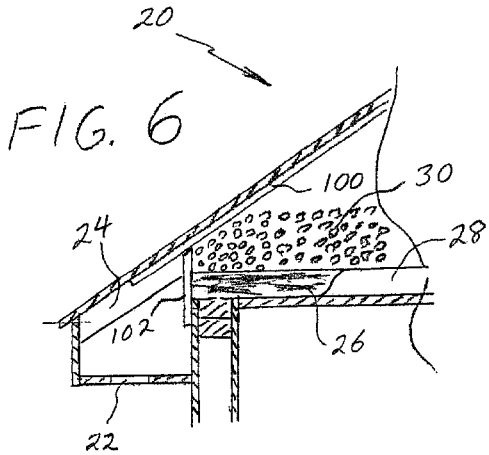
FIG. 6 PRIOR ART
FIG. 6 is a schematic transverse vertical cross section through a lower portion of a gable roof showing a current prior art practice of providing a vent chute for the flow of air to an open attic space and a separate loose fill insulation retainer or dam.

As shown in FIG. 1A, the separation of the flanges 66 and adjacent sidewalls 62 of the channels 58 of the insulation dam segment 44 from the flanges 56 and adjacent sidewalls 52 of the elongated chute segment 42 also enables the flanges 66 of the insulation dam segment to be positioned for securement in the soffit region of a roof structure to form an insulation dam to prevent loose fill insulation in an attic from flowing down into a soffit region of a roof and blocking air flow as will be discussed more fully in connection with FIGS. 3–5.

As shown in FIG. 1, preferably, the insulation dam segment 44 is provided with one or more transverse hinges or fold lines 68 intermediate the upper and lower ends of the insulation dam segment 44. Preferably, the hinge or fold line(s) 68 are parallel and spaced apart from each other and from the hinge or fold line 46 by at least two inches. The hinge or fold line(s) 68 enable the insulation dam segment to be folded intermediate its upper and lower ends when installing the dam segment portion as will be discussed in connection with FIG. 5. Preferably, the hinge or fold line(s) 68 have the same structure as the hinge or fold line 46 with score lines passing through the midportions 60 of the channels 58 to hold the insulation dam segment 44 together and perforated lines, slits or other lines of weakness passing through the sidewalls 62 and flanges 64 and 66 of the channels 58 to enable separation.

Preferably, the inwardly directed flanges 54 of the channels 48 of the elongated chute segment 42 and the inwardly directed flanges 64 of the channels 58 of the insulation dam segment 44 are separably joined together along the longitudinal centerline of the hinged vent chute 40 by a perforated or otherwise weakened line 70. The perforated or otherwise weakened line 70 enables the separation of the two channels 48 of the elongated chute segment 42 and the two channels 58 of the insulation dam segment 44 from each other at the line 70 to form two single channel, hinged vent chutes having half the width of the hinged vent chute 40 for separate installation between pairs of roof rafters which are spaced closer together than normal.

Figure 2:
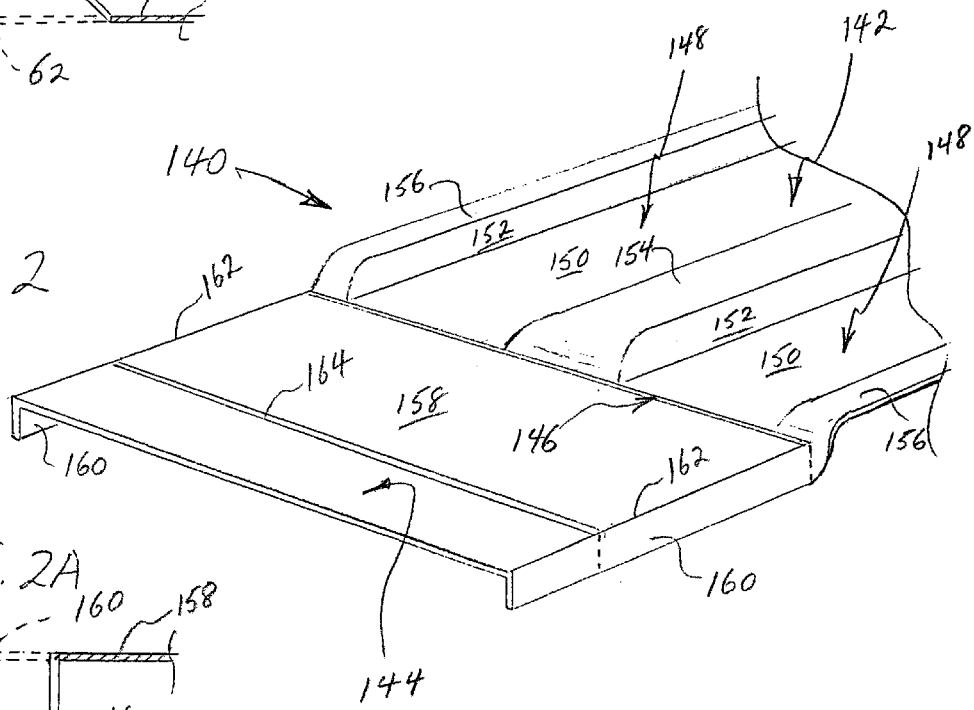
FIG. 2 is a perspective schematic view of a second embodiment of the hinged vent chute of the present invention with a portion of the elongated chute segment of the hinged vent chute broken away.
Figure 2A:
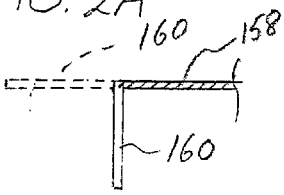
FIG. 2A is a partial cross section view of the insulation dam segment of the hinged vent chute of FIG. 2, taken substantially along the hinge or fold line joining the elongated chute segment to the insulation dam segment, to show in phantom line how the lateral edge portions of the insulation dam segment may be extended and positioned to provide stapling or securement flanges after the insulation dam segment is folded downward relative to the elongated vent chute segment.

The hinged vent chute 140 of FIG. 2 and 2A includes an elongated chute segment 142 and an insulation dam segment 144 which are joined by a transverse hinge or fold line 146. As shown in FIG. 2, the elongated chute segment 142 of the hinged vent chute 140 has two elongated, upwardly open channels 148 which extend from the hinge or fold line 146 at a lower end of the elongated chute segment 142 to an upper free end of the elongated chute segment 142. When the hinged vent chute 140 is installed, the upwardly open channels 148 provide an air passage from the soffit region of a roof, over an interior surface of the roof, up into an open attic space beneath the roof. Each channel 148 of the elongated chute segment 142 has a generally U-shaped transverse cross section with a midportion 150; a pair of sidewalls 152 extending upward from lateral edge portions of the midportion 150; a common flange 154 between the channels; and outwardly directed flanges 156, adapted to be placed against and stapled or otherwise secured to the interior surface of a roof. The common flange 154 and the outwardly directed flanges 156 extend in a generally common plane from upper edge portions of the sidewalls 152.

The insulation dam segment 144 preferably has a generally planar midportion 158 extending from the fold line 146 at an upper end of the insulation dam segment 144 to a lower free end of the insulation dam segment 144 and between the lateral edges of the insulation dam segment 144. A pair lateral flanges 160, extending generally perpendicular to the midsection 158 of the insulation dam segment, are joined to the lateral edge portions of the midsection 158 by hinge or fold lines 162.

As mentioned above, the lower end of the elongated chute segment 142 is joined to the upper end of the insulation dam segment 144 by a hinge or fold line 146, extending generally perpendicular to the lengths of the elongated chute segment and the insulation dam segment between the lateral edges of the elongated chute segment and the insulation dam segment. The hinge or fold line 146 permits the insulation dam segment 144 to be folded downward relative to the elongated chute segment 142 along the hinge or fold line 146 with the lateral flanges 160 of the insulation dam segment 144 separating from the outer flanges 156 of the channels 148 of the elongated chute segment 142 to enable the folding or bending of the hinged vent chute 140 along the hinge or fold line 146. The portion of the hinge or fold line 146 located at the juncture of the midportion 158 of the insulation dam segment 144 and the midportion of the elongated chute segment intermediate the outer flanges 156 of the channels 148 holds the insulation dam segment and the elongated chute segment together when the insulation dam segment 144 is folded downward along the hinge or fold line 146 relative to the elongated chute segment 142. Preferably, the portion of the hinge or fold line 146 which folds and maintains the insulation dam segment 144 integral with the elongated chute segment 142 is a score line which is molded or otherwise formed in the hinged vent chute 140 at the juncture between midportion 158 of the insulation dam segment 144 and the midportion of the elongated chute segment 142 between the flanges 156. Preferably, the separable portions of the hinge or fold line 146 are perforated lines, slits or other lines of weakness formed in the hinged vent chute 140 at the juncture between the flanges 156 of the channels 148 and the flanges 160 of the insulation dam segment which enable the hinge or fold line 146 to be separated or broken apart along these separable portions. As shown in FIG. 2, the lower portion of the elongated chute segment 142, adjacent its juncture with the insulation dam segment 144, has a transition region where the sidewalls 152 and the flanges 154 and 156 of the elongated chute segment transition to the common plane of the channel midportions 150 and the midportion 158 of the insulation dam segment and the flanges 156 of the elongated chute segment transition into the flanges 160 of the insulation dam segment.

As shown in FIG. 2A, the separation of the flanges 160 of the insulation dam segment 144 from the flanges 156 of the elongated chute segment 142 also enables the flanges of the insulation dam segment to be positioned for securement in the soffit region of a roof structure to form an insulation dam to prevent loose fill insulation in an attic from flowing down into a soffit region of a roof and blocking air flow as will be discussed more fully in connection with FIGS. 3–5.

As shown in FIG. 2, preferably, the insulation dam segment 144 is provided with one or more transverse hinges or fold lines 164 intermediate the upper and lower ends of the insulation dam segment 144. Preferably, the hinge or fold line(s) 164 are parallel and spaced apart from each other and from the hinge or fold line 146 by two to four inches and from the lower free end of the insulation dam chute by at least four inches. The hinge or fold line(s) 164 enable the insulation dam segment 144 to be folded intermediate its upper and lower ends when installing the insulation dam segment 144 as will be discussed in connection with FIG. 5. Preferably, the hinge or fold line(s) 164 have the same structure as the hinge or fold line 146 with a score lines passing through the midportion 158 of the insulation dam segment to hold the insulation dam segment 144 together and perforated lines, slits or other lines of weakness passing through the flanges 160 of the insulation dam segment to enable separation.

Preferably, the hinged vent chutes 40 and 140 are made of an inexpensive material such as but not limited to: extruded polystyrene foam; paperboard (e.g. paperboard treated with a water repellant such as but not limited to wax); molded acrylonitrile-butadiene-styrene (ABS); and extruded polyvinyl chloride (PVC). Typically, the elongated chute segments 42 and 142 of the hinged vent chutes 40 and 140 are from about 24 inches to about 48 inches in length and either about 14½ to about 15 inches or about 22½ to about 23 inches in width. Typically, the insulation dam segments 44 and 144 of the hinged vent chutes 40 and 140 are from about 4 to about 12 inches in length and, prior to folding the hinged vent chute at the hinge or fold line 46 or 146, either about 14½ to about 15 inches or about 22½ to about 23 inches in width. Thus, the width of the elongated chute segment 42 of the hinged vent chute 40 and the width of the elongated chute segment 142 of the hinged vent chute 140 are about equal to or slightly greater than the spacing between adjacent or successive 1½ inch wide (2×4) standard rafters 24 when the rafters are located on standard 16 or 24 inch centers. The width of the insulation dam segment 44 of the hinged vent chute 40 and the width of the insulation dam segment 144 of the hinged vent chute 140, prior to folding the hinged vent chute 40 or 140 at the hinge or fold line 46 or 146, are about equal to or slightly greater than the spacing between adjacent or successive 1½ inch wide (2×4) standard ceiling joists 28 when the ceiling joists 28 are located on standard 16 or 24 inch centers. For installations where the rafters 24 and ceiling joists are spaced on about 12 inch centers, the hinged vent chute 40 can be separated along the perforated centerline 70 to form two single channel, hinged vent chutes which are each about 11¼ inches wide. While the hinged vent chute 40 shown in FIG. 1 has two channels, a hinged vent chute can also be made with only one channel about 22 inches or about 14 inches wide for use with rafters and ceiling joists on 24 and 16 inch centers.

The air passage formed by each channel 48 of the hinged vent chute 40 and each channel 148 of the vent chute 140 is generally about 1 to 2 inches deep and about 7 to 9 inches wide when the width of the hinged vent chute is about 22½ to about 23 inches wide and about 5 inches wide when the width of the hinged vent chute is about 14½ to about 15 inches wide. The flanges 54, 56 and 160 are typically about 1 to about 2 inches wide.

When the insulation dam segment 44 of the hinged vent chute 40 is folded downward along the hinge or fold line 46 relative to the elongated chute segment, the separation of the outer flanges 66 and adjacent sidewalls 62 of the insulation dam segment 44 from the outer flanges 56 and adjacent sidewalls 52 of the elongated chute segment permit the outer flanges 66 and the adjacent sidewalls 62 of the insulation dam segment to be positioned as shown in FIG. 1A where the flanges 66 can be extended out from the adjacent sidewalls 62 beyond the original width of the elongated chute segment and the insulation dam segment for securement to the soffit region of a roof structure as shown in FIG. 3 or extended perpendicular to the adjacent sidewalls 62 at about the original width of the elongated chute segment and the insulation dam segment for securement to opposed surfaces of adjacent or successive ceiling joists 28 as shown in FIGS. 4 and 5.

When the insulation dam segment 144 of the hinged vent chute 140 is folded downward along the hinge or fold line 146 relative to the elongated chute segment, the separation of the outer or lateral flanges 160 of the insulation dam segment 144 from the outer flanges 156 of the elongated chute segment permit the outer or lateral flanges 160 of the insulation dam segment to be positioned as shown in FIG. 2A where the flanges 160 can be extended out from the midportion 158 of the insulation dam segment beyond the original width of the elongated chute segment and the insulation dam segment for securement to the soffit region of a roof structure as shown in FIG. 3 or extended perpendicular to the midportion 158 of the insulation dam segment at the original width of the elongated chute segment and the insulation dam segment for securement to opposed surfaces of adjacent or successive ceiling joists 28 as shown in FIGS. 4 and 5.

FIGS. 3 to 5 show typical installations of the hinged vent chutes 40 or 140 in a gable roof 20. The gable roof 20 has a plurality of vents 22 installed in the soffit region of the roof 20 (only one of which is shown). Normally, the elongated chute segment 42 or 142 of hinged vent chute 40 or 140 is secured to the underside of the roof sheathing 32 (e.g. board or plywood sheathing) between each pair of rafters 24 and extends from the soffit region of the roof 20 up into the open attic space beneath the roof 20. The upwardly open channel (s) 48 or 148 in the hinged vent chute 40 or 140 provide an air passage between the hinged vent chute 40 or 140 and the underside of the roof sheathing 32 from the soffit region of the roof to the open attic space beneath the roof 20. The flanges 56 of the hinged vent chute 40 and 156 of the hinged vent chute 140 are stapled or otherwise secured to the underside of the sheathing 32 of the roof 20 adjacent successive rafters 24.

The rooms beneath the open attic space are insulated from the open attic space by batts or blankets of insulation 26, such as but not limited to glass fiber insulation, that have been installed between the adjacent or successive ceiling joists 28 and a layer of loose fill insulation 30, such as but not limited to glass fiber blowing wool or a layer of loose fill insulation 30 both between and above the ceiling joists 28. As shown in FIGS. 3 to 5, the insulation dam segment 44 or 144 of the one piece hinged vent chute 40 or 140 has been bent or folded downward at a fold line 46 or 146 relative to the elongated chute segment 42 or 142.

In the installation of FIG. 3, the free lower end of insulation dam segment 44 or 144 extends down below the top plate 36 of the outside wall. The flanges 66 of the insulation dam segment 44 are folded into the plane of the midportions 60 of the insulation dam segment channels 58, as shown in FIG. 1A, or the flanges 160 of the insulation dam segment 144 are folded into the plane of the midportion 158 of the insulation dam segment, as shown in FIG. 2A, and are secured to an interior surface 34 of the soffit by staples or other conventional fasteners to form an insulation dam between the underside of the sheathing and the top plate 36 of the outside wall.

In the installation of FIG. 4, the lower free end of the insulation dam segment is placed in contact with the top plate 36 of the outside wall. The flanges 66 of the insulation dam segment 44 are folded perpendicular to the plane of the midportions 60 of the insulation dam segment channels 58, as shown in FIG. 1A, or the flanges 160 of the insulation dam segment 144 are left perpendicular to the plane of the midportion 158 of the insulation dam segment, as shown in FIG. 2A, and are secured to opposed surfaces of adjacent or successive ceiling joists 28 in the soffit region by staples or other conventional fasteners to form an insulation dam between the underside of the sheathing and the top plate 36 of the outside wall.

In the installation of FIG. 5, the insulation dam segment 44 or 144 is placed in contact with the top plate 36 of the outside wall at the fold line 68 or 164 intermediate the ends of the insulation dam segment and extends inward from the line of contact. The flanges 66 of the insulation dam segment 44 are folded perpendicular to the plane of the midportions 60 of the insulation dam segment channels 58, as shown in FIG. 1A, or the flanges 160 of the insulation dam segment 144 are left perpendicular to the plane of the midportion 158 of the insulation dam segment, as shown in FIG. 2A, and are secured to opposed surfaces of adjacent or successive ceiling joists 28 in the soffit region by staples or other conventional fasteners to form an insulation dam between the underside of the sheathing and the top plate 36 of the outside wall.

The hinged vent chutes 40 or 140 are installed prior to insulating the attic so that the loose fill insulation 28 is not blown into the soffit region of the roof to block the airflow from the soffit vents 22 to the air passages formed by the hinged vent chutes 40 or 140 with the underside of the roof 20.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A hinged vent chute for providing ventilation to open attic space and an insulation dam, comprising:

an elongated chute segment and an insulation dam segment having a substantially identical transverse cross section;

the elongated chute segment having a width defined by lateral edges and a length defined by a lower end and an upper free end;

the insulation dam segment having a width defined by lateral edges and a length defined by a lower free end and an upper end;

an upwardly opening channel means extending for the length of the elongated chute segment and the insulation dam segment; the channel means having a transverse cross section with a midportion, sidewalls which extend upwardly from lateral edge portions of the midportion, and lateral edge flanges which extend in a generally common plane away from upper edge portions of the sidewalls;

the upwardly opening channel means having a portion, extending from the lower end to the upper end of the elongated chute segment, for providing an air passage from a soffit region of a roof, over an interior surface of the roof, up into the open attic space beneath the roof when the elongated chute segment is secured in place with elongated chute segment portions of the lateral edge flanges placed against the interior surface of the roof;

the lower end of the elongated chute segment being joined to the upper end of the insulation dam segment by a first hinge means, extending generally perpendicular to the lengths of the elongated chute segment and the insulation dam segment between the lateral edges of the elongated chute segment and the insulation dam segment, for permitting the insulation dam segment to be folded downward relative to the elongated chute segment and secured in place to form the insulation dam to prevent loose fill insulation in the attic from flowing down into the soffit region of the roof and blocking air flow; the first hinge means including a score line portion which folds and maintains the insulation dam segment integral with the elongated chute segment when the insulation dam segment is folded downward along the first hinge means relative to the elongated chute segment; the first hinge means including separable perforated line portions which separate when the insulation dam segment is folded downward along the first hinge means relative to the elongated chute segment to permit: the insulation dam segment to be folded downward relative to the elongated channel segment along the first hinge means; the sidewalls and lateral edge flanges of the channel means to separate between the elongated chute segment and the insulation dam segment; and inner portions of the insulation dam segment portions of the lateral edge flanges, where the insulation dam segment portions of the lateral edge flanges are joined to a remainder of the insulation dam segment, to be moved apart from each other a distance substantially equal to the width of the elongated chute segment to enable the insulation dam segment portions of the lateral edge flanges to be oriented and positioned for securement to a building at or adjacent the soffit of the building; and the insulation dam segment having a second hinge means, intermediate the lower free end and the upper end of the insulation dam segment and spaced at least two inches from the first hinge means, that extends in a direction generally parallel to the first hinge means between lateral edges of the insulation dam segment.

2. The hinged vent chute according to claim 1, wherein:

the hinged vent chute is made of a material selected from a group consisting of: extruded polystyrene foam, paperboard, molded acrylonitrile-butadiene-styrene; and extruded polyvinyl chloride.

3. The hinged vent chute according to claim 1, wherein:

the length of the elongated chute segment is from about 24 inches to about 48 inches and the width of the elongated chute segment is from about 22½ inches to about 23 inches; the length of the insulation dam segment is from about 4 inches to about 12 inches and the width of the insulation dam segment is from about 22½ to about 23 inches prior to folding the insulation dam segment downward relative to the elongated chute segment along the first hinge means.

4. The hinged vent chute according to claim 1, wherein:

the length of the elongated chute segment is from about 24 inches to about 48 inches and the width of the elongated chute segment is from about 14½ inches to about 15 inches; the length of the insulation dam segment is from about 4 inches to about 12 inches and the width of the insulation dam segment is from about 14½ to about 15 inches prior to folding the insulation dam segment downward relative to the elongated chute segment along the first hinge means.

5. The hinged vent chute according to claim 1, wherein:

the upwardly opening channel means is a single channel with a generally U-shaped transverse cross section.

6. The hinged vent chute according to claim 1, wherein:

the upwardly opening channel means includes first and second channels that each has a generally U-shaped transverse cross section.

7. The hinged vent chute according to claim 6, wherein:

the elongated chute segment and the insulation dam segment are separably joined along the lengths of the elongated chute segment and the insulation dam segment.

8. The hinged vent chute according to claim 7, wherein:

the length of the elongated chute segment is from about 24 inches to about 48 inches and the width of the elongated chute segment is from about 22½ inches to about 23 inches; and the length of the insulation dam segment is from about 4 inches to about 12 inches and the width of the insulation dam segment is from about 22½ to about 23 inches prior to folding the insulation dam segment downward relative to the elongated chute segment along the first hinge means.

* * * * *